US010815659B1

(12) United States Patent
Miller et al.

(10) Patent No.: US 10,815,659 B1
(45) **Date of Patent: *Oct. 27, 2020**

(54) PREFABRICATED FORM FOR FIREPROOFING STRUCTURAL STEEL AND METHOD OF USE

(71) Applicant: Alfred Miller Contracting Company, Lake Charles, LA (US)

(72) Inventors: Philip Glen Miller, Lake Charles, LA (US); Robert Brooks Pool, Lake Charles, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/736,900

(22) Filed: Jan. 8, 2020

Related U.S. Application Data

(63) Continuation-in-part of application No. 15/892,910, filed on Feb. 9, 2018, now Pat. No. 10,533,318.

(60) Provisional application No. 62/457,518, filed on Feb. 10, 2017.

(51) Int. Cl.
*E04B 1/94* (2006.01)
*E04C 3/06* (2006.01)

(52) U.S. Cl.
CPC ..... *E04B 1/944* (2013.01); *E04B 1/947* (2013.01); *E04C 3/06* (2013.01); *E04B 2103/06* (2013.01)

(58) Field of Classification Search
CPC ..... E04B 1/944; E04B 1/947; E04B 2103/06; E04C 3/06
See application file for complete search history.

(56) References Cited

U.S. PATENT DOCUMENTS

| | | | | | |
|---|---|---|---|---|---|
| 2,213,603 | A | * | 9/1940 | Young | E04B 1/943 52/344 |
| 3,516,213 | A | * | 6/1970 | Sauer | E04B 1/944 52/834 |
| 3,570,208 | A | | 3/1971 | Nikai | |
| 3,913,290 | A | | 10/1975 | Billing | |
| 4,069,075 | A | | 1/1978 | Billing | |
| 4,292,358 | A | | 9/1981 | Fryer | |
| 4,493,945 | A | * | 1/1985 | Feldman | A62C 3/16 174/68.3 |
| 4,584,811 | A | | 4/1986 | Balinski | |
| 4,729,916 | A | * | 3/1988 | Feldman | A62C 3/16 156/292 |
| 5,157,887 | A | | 10/1992 | Watterworth, III | |
| 5,356,446 | A | | 10/1994 | Smetana | |
| 5,433,991 | A | | 7/1995 | Boyd, Jr. | |
| 5,580,648 | A | | 12/1996 | Castle | |

(Continued)

*Primary Examiner* — Rodney Mintz
(74) *Attorney, Agent, or Firm* — Katarzyna Brozynski; Antonio Devora

(57) ABSTRACT

A prefabricated formed edge guide for fireproofing a structural steel member and method of use is disclosed, which includes a formed edge, a set of mesh surfaces attached to the formed edge, and a thickness formed by the formed edge and the set of mesh surfaces. A fireproofed structure is disclosed that includes a member including a set of surfaces, a set of the preformed edge guides attached to the set of surfaces, and a fireproofing thickness formed by the formed edge and the set of mesh surfaces. A fireproofing material is adhered to the member using the set of preformed edge guides and the fireproofing thickness to create the fireproofed structure. The fireproofing material may be applied in one single layer or in successive layers.

7 Claims, 5 Drawing Sheets

(56) References Cited

U.S. PATENT DOCUMENTS

| | | | | |
|---|---|---|---|---|
| 5,622,774 | A * | 4/1997 | Feldman | B32B 5/26 442/136 |
| 6,096,812 | A | 8/2000 | Hanafin | |
| 9,133,617 | B2 | 9/2015 | Green | |
| 9,140,005 | B2 | 9/2015 | Miller | |
| 9,540,813 | B2 * | 1/2017 | Miller | E04C 3/293 |
| 9,663,943 | B2 | 5/2017 | Dimakis | |
| 10,156,066 | B2 | 12/2018 | Cormack | |
| 10,533,318 | B1 * | 1/2020 | Miller | E04B 1/944 |
| 2005/0031843 | A1 | 2/2005 | Robinson | |
| 2005/0039414 | A1 | 2/2005 | Miller | |
| 2006/0272268 | A1 | 12/2006 | Miller | |
| 2007/0066165 | A1 | 3/2007 | Fyfe | |
| 2008/0044648 | A1 | 2/2008 | Billings | |
| 2009/0272070 | A1 | 11/2009 | Zureick | |
| 2009/0313937 | A1 | 12/2009 | Zureick | |
| 2013/0167475 | A1 | 7/2013 | Ramos | |
| 2014/0076482 | A1 | 3/2014 | Kunk | |
| 2014/0099456 | A1 | 4/2014 | Raghavendran | |
| 2014/0352243 | A1 | 12/2014 | Miller | |
| 2016/0040428 | A1 | 2/2016 | Miller | |
| 2016/0168393 | A1 | 6/2016 | Kreh | |
| 2016/0168394 | A1 | 6/2016 | Kreh | |
| 2016/0168415 | A1 | 6/2016 | Kreh | |
| 2016/0272891 | A1 | 9/2016 | Tong | |
| 2017/0081844 | A1 | 3/2017 | Dimakis | |
| 2018/0038098 | A1 | 2/2018 | Wall | |
| 2018/0328022 | A1 | 11/2018 | Cormack | |
| 2019/0264442 | A1 | 8/2019 | Wall | |

* cited by examiner

PREFABRICATED FORM FOR FIREPROOFING STRUCTURAL STEEL AND METHOD OF USE

CROSS-REFERENCE TO RELATED APPLICATIONS

This application is a continuation application of U.S. application Ser. No. 15/892,910, filed Feb. 9, 2018, which claims priority to U.S. Provisional Application No. 62/457,518, filed Feb. 10, 2017. Each of the above patent applications is incorporated herein by reference in its entirety to provide continuity of disclosure.

TECHNICAL FIELD

The present invention relates to structural fireproofing systems and methods. In particular, the present invention relates to a device that forms a set of edges for application of fireproofing material to a set of structural members.

BACKGROUND OF THE INVENTION

In the prior art, applying fireproofing material, such as intumescent epoxy, to a member such as a structural steel member is a tedious, time-consuming, and expensive process. Referring to FIG. 1, by way of example in the prior art, fireproofed member 100 includes member 101 surrounded by fireproofing material 102. Fireproofing material 102 has thickness 103. Thickness 103 varies and is non-uniform as it surrounds member 101. In the prior art, fireproofing material 102 is sprayed onto member 101 and a paint thickness gauge to assess the thickness 103 of the intumescent epoxy fireproofing material 102 with each successive pass.

Fire proofing material, intumescent epoxy material in particular, is extremely expensive, so applying excessive thickness is undesirable. The process of obtaining fireproofing rating for the fireproofed structural members requires a minimum thickness of fireproofing material, so applying insufficient thickness is also undesirable.

Therefore, there is a need in the art for a device for applying the correct thickness of fireproofing material in a uniform coating that does not require continuous measurement with a thickness gauge on all surfaces.

SUMMARY

A prefabricated formed edge guide for fireproofing a structural steel member and method of use is disclosed. The prefabricated formed edge guide includes a formed edge, a set of mesh surfaces attached to the formed edge, and a thickness formed by the formed edge and the set of mesh surfaces.

A fireproofed structure is disclosed that includes a member including a set of surfaces, a set of preformed edge guides attached to the set of surfaces, each of which includes a formed edge, a base surface attached to the formed edge, a set of mesh surfaces attached to the base surface, and a fireproofing thickness formed by the formed edge and the set of mesh surfaces. A fireproofing material is adhered to the member using the set of preformed edge guides and the fireproofing thickness to create the fireproofed structure.

A method for fireproofing a structural member is disclosed. The method includes the steps of providing a set of preformed edge guides, each of which includes a formed edge, a base surface attached to the formed edge, a set of mesh surfaces attached to the base surface, and a fireproofing thickness formed by the formed edge and the set of mesh surfaces, attaching the set of preformed edge guides to the structural member, and applying a fireproofing material to the structural member using the set of preformed edge guides according to the fireproofing thickness. The fireproofing material may be applied in one single layer or in successive layers.

The preformed edge guide establishes automatic alignment for application of the correct thickness of fireproofing material and provides a dam for the wet fireproofing material allowing successive application of adjacent surfaces.

The formed edge provides the fireproofing material cover for the flange tips of a structural steel member. The formed edge also provides a uniform screed edge for subsequent fireproofing material application on the remaining surfaces of the member.

BRIEF DESCRIPTION OF THE DRAWINGS

In the detailed description presented below, reference will be made to the following drawings.

DETAILED DESCRIPTION

Figure 2A:
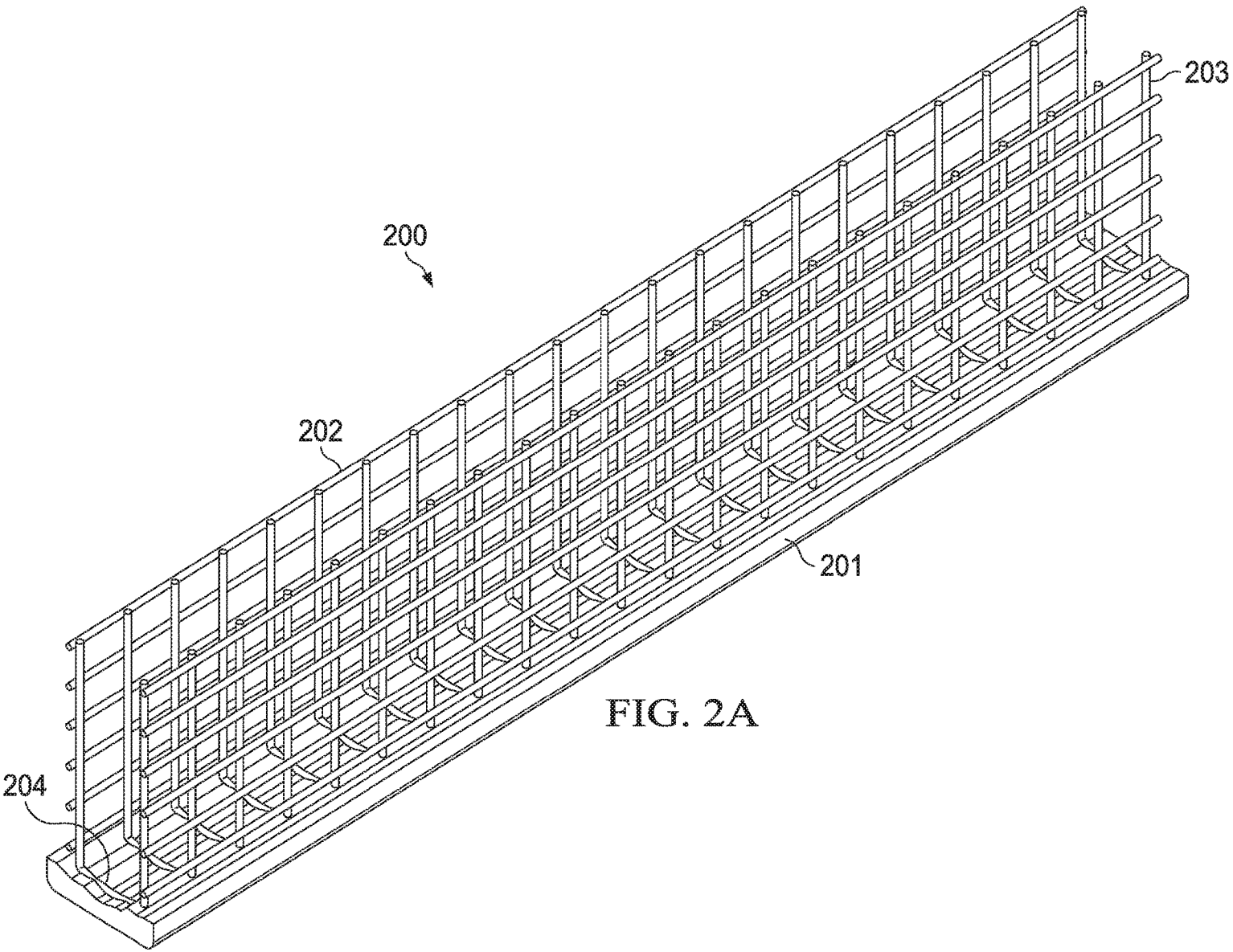
FIG. 2A is an isometric view of a formed edge guide of a preferred embodiment.

Referring to FIG. 2A, formed edge guide 200 includes formed edge 201, mesh surface 202 attached to formed edge 201, and mesh surface 203 attached to formed edge 201.

In a preferred embodiment, each of mesh surfaces 202 and 203 is attached to base surface 204. Base surface 204 is attached to formed edge 201.

In a preferred embodiment, mesh surfaces 202 and 203 and base surface 204 are formed from a single piece wire mesh. In this embodiment, the single piece of wire mesh is bent with a set of bends integrally formed therein to form mesh surfaces 202 and 203 and base surface 204. In this embodiment, base surface 204 is embedded into formed edge 201. Any means of attachment known in the art may be employed.

In a preferred embodiment, the wire mesh is made of a metal or metal alloy. Other suitable materials known in the art may be employed, including but not limited to carbon fiber and plastics.

In a preferred embodiment, the wire mesh is made of a set of longitudinal ribs arranged in a substantially parallel fashion to formed edge 201 and to each other, and a set of transverse ribs disposed between and extending substantially perpendicular to formed edge 201 and the set of longitudinal ribs, each of which is preferably sixteen gauge welded wire. A plurality of void areas of the approximate size 0.5 inches×0.5 inches are disposed between the set of longitudinal ribs and the set of transverse ribs, such that each said void area is bounded by at least two longitudinal ribs and at least two transverse ribs. In other embodiments, other suitable materials and arrangements known in the art are employed.

In a preferred embodiment, formed edge 201 is made of a fireproofing material, such as an intumescent epoxy. Other suitable fireproofing materials known in the art may be employed.

Figure 2B:
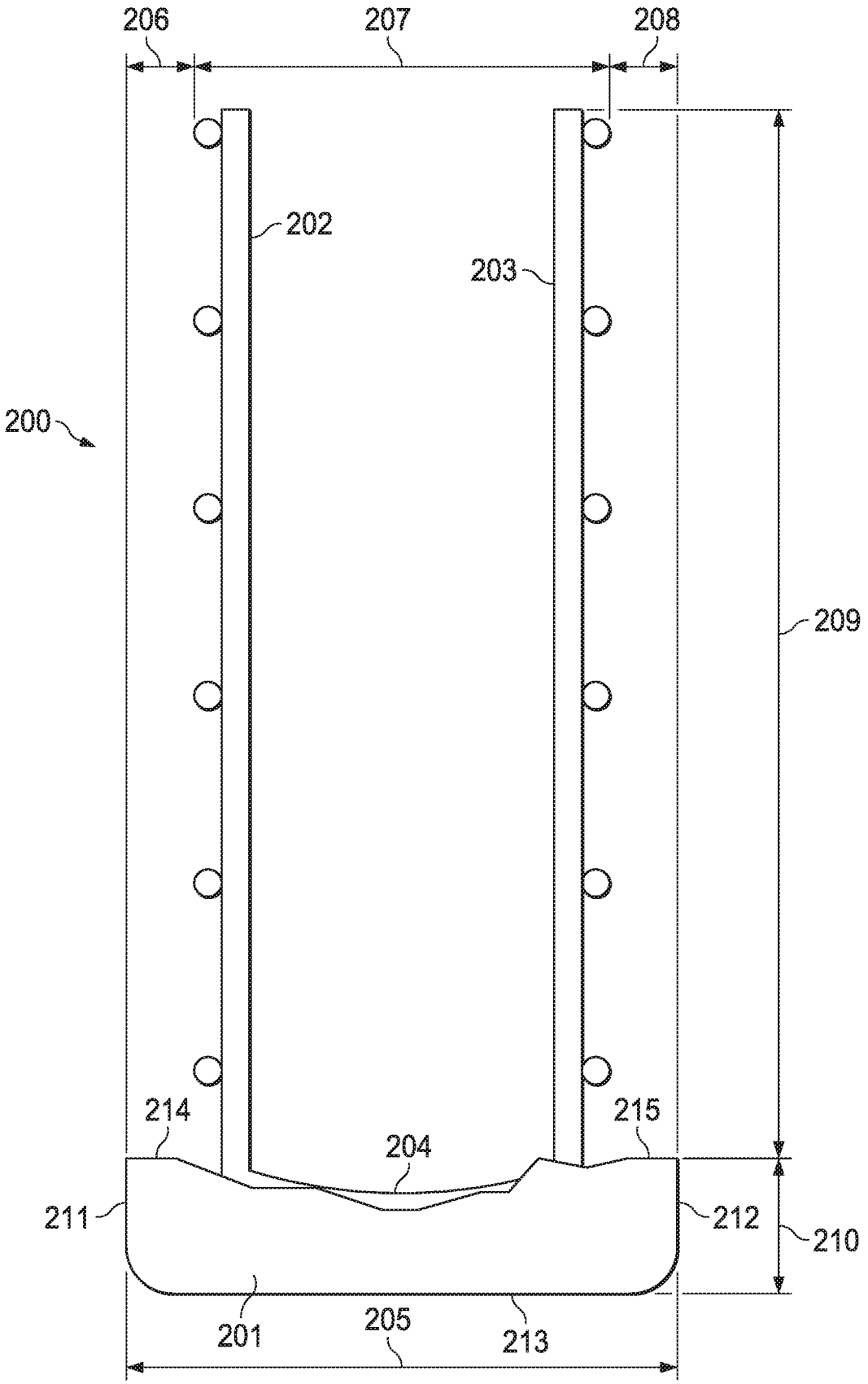
FIG. 2B is an end view of a formed edge guide of a preferred embodiment.

Referring to FIG. 2B, mesh surfaces 202 and 203 are generally parallel with respect to each other and each of mesh surfaces 202 and 203 extends generally perpendicularly from formed edge 201. Formed edge 201 includes edge 213 having width 205 and sides 211 and 212, each having thickness 210. Formed edge 201 further includes edge surface 214 adjacent to side 211 and mesh surface 202. Edge surface 214 has width 206. Edge surface 215 is adjacent to side 212 and mesh surface 203. Edge surface 215 has width 208. Mesh surfaces 202 and 203 are separated by width 207. Each of mesh surfaces 202 and 203 extend distance 209 from edge surfaces 214 and 215 of formed edge 201.

In a preferred embodiment, the sum of widths 206, 207, and 208 is approximately equal to width 205. Other dimensional arrangements may be employed.

In a preferred embodiment, widths 206 and 208 of edge surfaces 214 and 215, respectively, are approximately equal. Other dimensional arrangements may be employed.

In a preferred embodiment, thickness 210 is approximately equal to each of widths 206 and 208 of edge surfaces 214 and 215, respectively. In this embodiment, a uniform thickness of fireproofing material may be applied. Other dimensional arrangements may be employed.

In a preferred embodiment, distance 209 is approximately six (6) inches. Other distances may be employed.

It will be appreciated by those skilled in the art that any of the dimensions of formed edge guide 200 may be modified to suit any desired fireproofing arrangement to vary any thickness of the fireproofing material upon application.

Figure 3A:
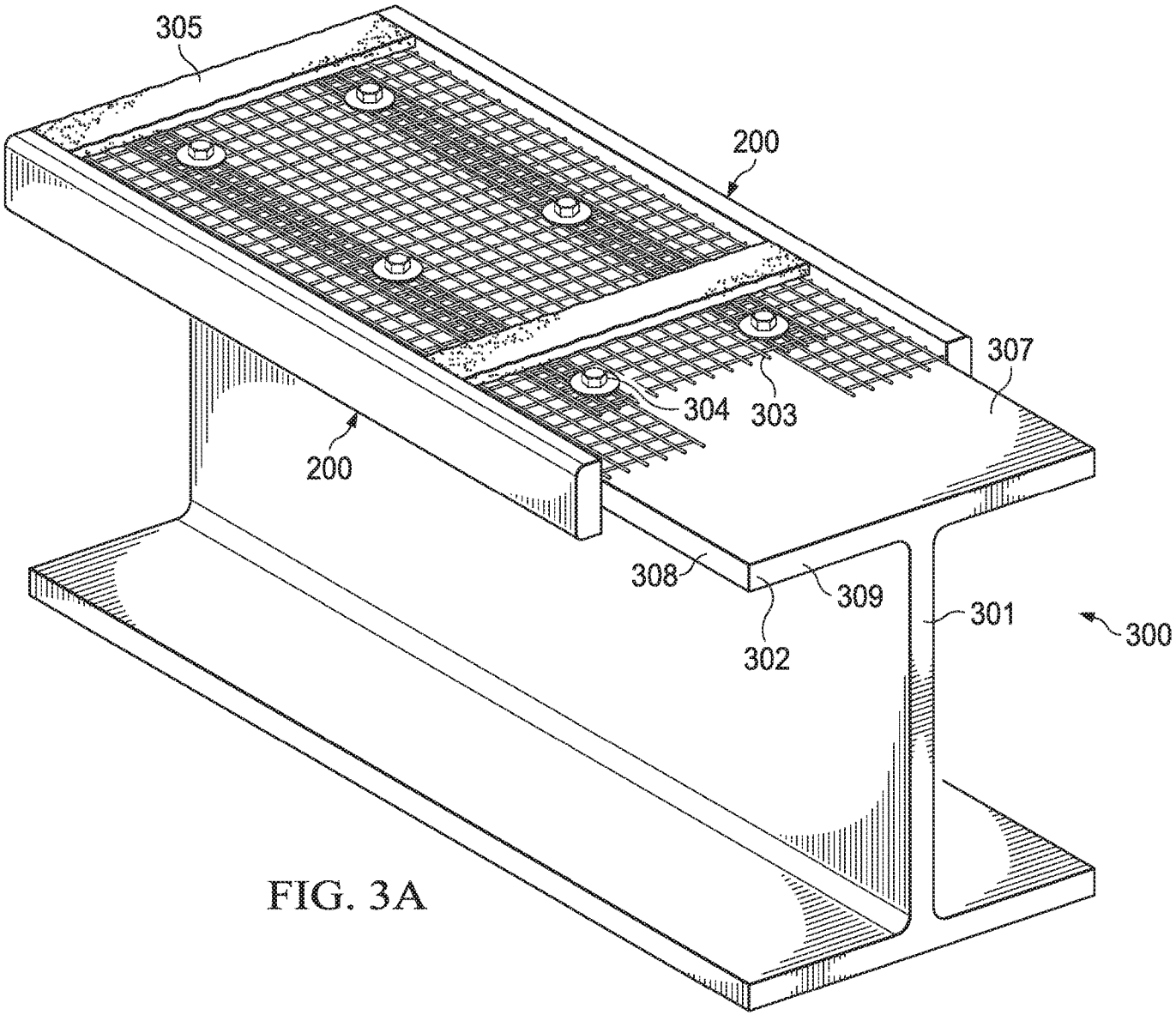
FIG. 3A is an isometric view of a formed edge guide attached to a structural member and a portion of fireproofing material applied to the formed edge guide and the structural member of a preferred embodiment.
Figure 3B:
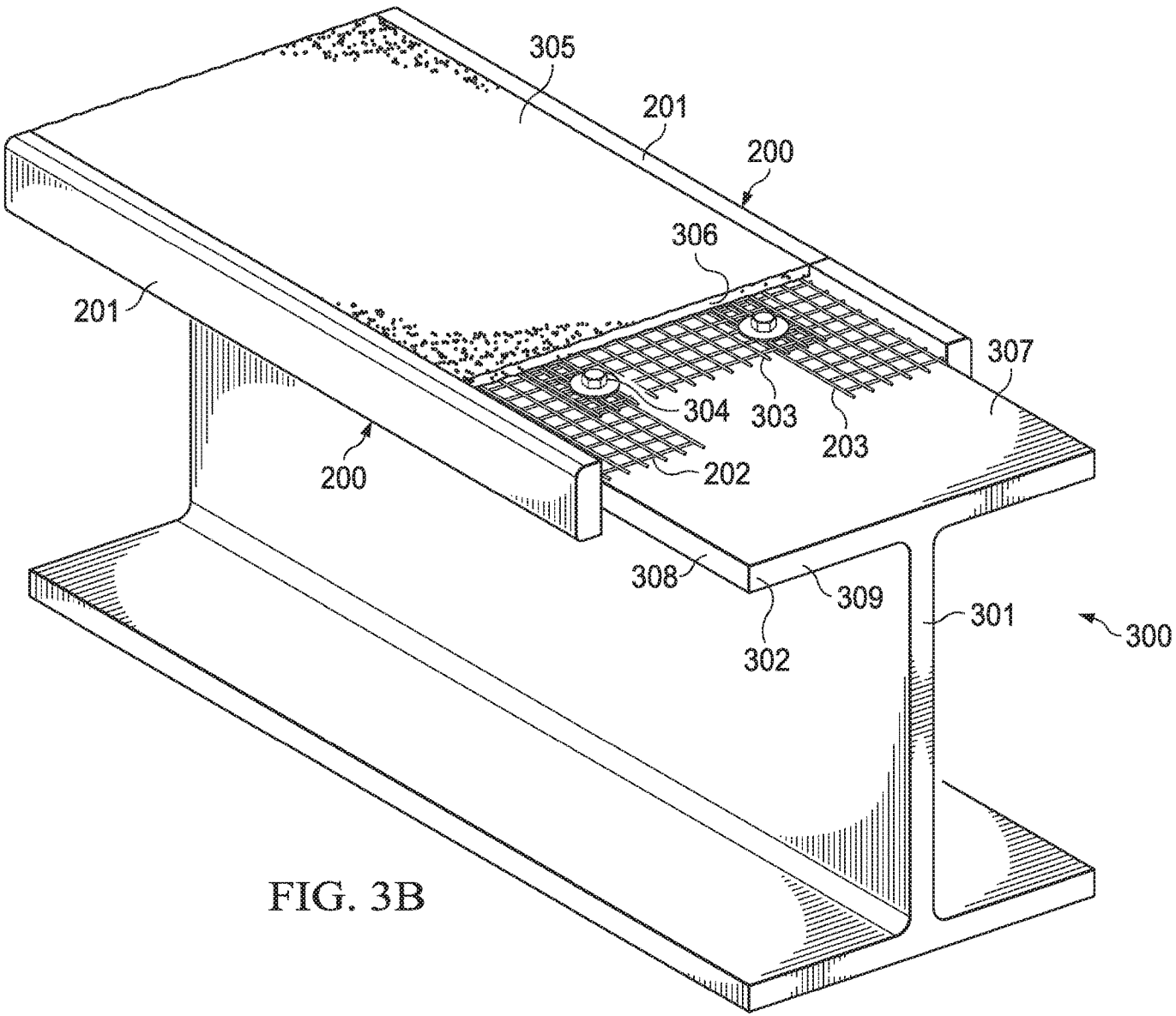
FIG. 3B is an isometric view of a formed edge guide attached to a structural member and a portion of fireproofing material applied to the formed edge guide and the structural member of a preferred embodiment.

Referring to FIGS. 3A and 3B in use, structural member 300 includes web 301 and flange 302 attached to web 301. Set of formed edge guides 200 is attached to flange 302 with set of fasteners 304 and mesh 303. Fireproofing material 305 is applied to structural member 300 using set of formed edge guides 200. Once applied, fireproofing material 305 has thickness 306, which is preferably generally uniform across flange 302.

In a preferred embodiment, structural member 300 is a steel "I-beam". Other suitable materials known in the art may be employed.

In a preferred embodiment, fireproofing material 305 is an intumescent epoxy. Other suitable fireproofing materials known in the art may be employed.

In a preferred embodiment, fireproofing material 305 is sprayed, poured, or troweled using formed edge guide to assure the appropriate desired thickness of fireproofing material 305. Any application means known in the art may be employed.

As can be seen in FIGS. 3A and 3B, formed edge guide 200 establishes automatic alignment for application of the correct thickness of fireproofing material and provides a dam for the wet intumescent epoxy material allowing successive application of adjacent surfaces of flange 302.

Formed edge guide 200 enables fireproofing material 305 to cover the flanges of structural member 300, and also provides a uniform screed edge for subsequent intumescent epoxy material application on the remaining surfaces of structural member 300.

Formed edge guide 200 enables the accurate gauging of thickness 306 of fireproofing material 305 along three (3) surfaces, i.e., surfaces 307, 308, and 309 of flange 302 by providing a rigid screed edge formed by formed edge 201.

Formed edge guide 200 further provides a dam to contain fireproofing material 305 when wet.

Figure 1:
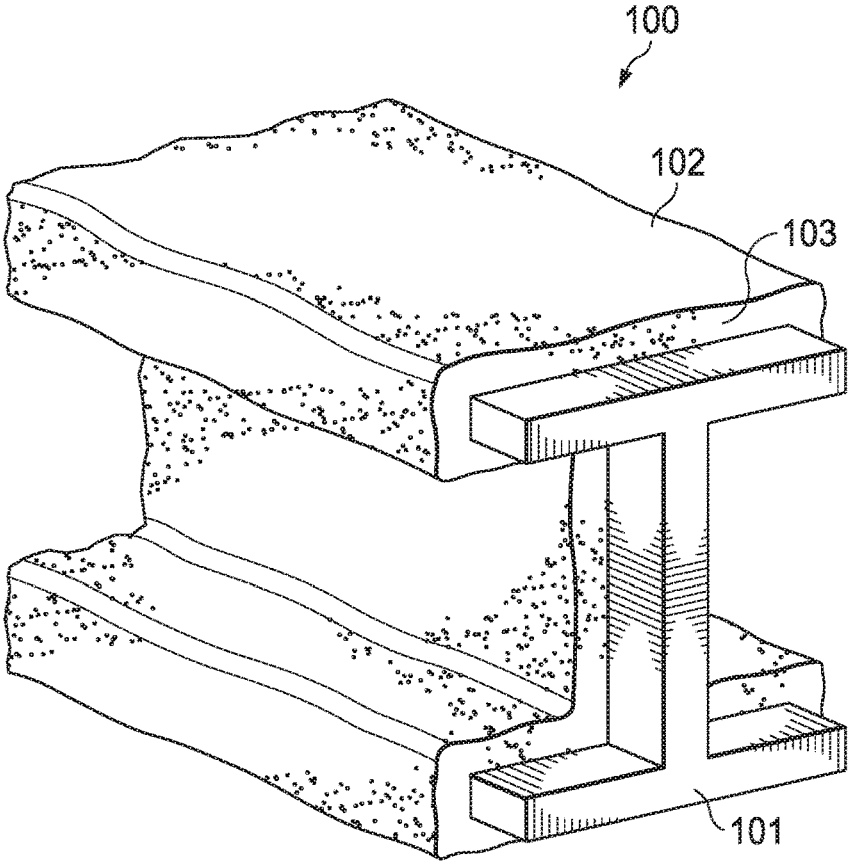
FIG. 1 (PRIOR ART)
FIG. 1 is an isometric view of a fireproofed member of the prior art.
Figure 4:
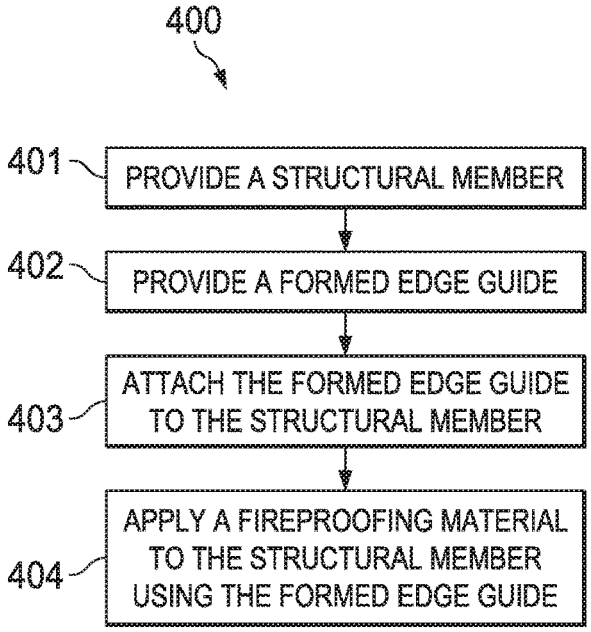
FIG. 4 is a flowchart of a method for fireproofing a structural member using the formed edge guide of a preferred embodiment.

Referring to FIG. 4, method 400 for fireproofing a structural member will be described. At step 401, a structural member is provided. In a preferred embodiment, the structural member is structural steel. Any suitable material, structural and non-structural, known in the art may be employed. At step 402, a formed edge guide is provided. At step 403, the formed edge guide is attached to the structural member. Any means of attachment, including but not limited to fasteners, known in the art may be employed. At step 404, a fireproofing material is applied to the structural member using the formed edge guide. In a preferred embodiment, step 404 is repeated to apply a set of layers of the fireproofing material until a desired thickness of the fireproofing material is achieved. Step 404 may be repeated any number of times.

In one embodiment, method 400 is performed once. In other embodiments, method 400 is performed any number times to fireproof any number of structural members.

In some embodiments, any number of subsets of steps 401, 402, 403, and 404 are repeated to fireproof a set of structural members.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A system for fireproofing a structural member comprising:

a preformed device configured to be attached to a structural surface of the structural member, the device comprising:

a formed edge comprising a set of edge surfaces;

a set of mesh surfaces comprising:

a base surface, the base surface embedded in the formed edge;

a first mesh surface connected to the base surface;

a second mesh surface connected to the base surface, wherein the first mesh surface and the second mesh surface are integrally connected together by the base surface and extend a distance beyond the set of edge surfaces; and, a fireproofing thickness formed by the formed edge and the set of mesh surfaces.

2. The system of claim 1, wherein the fireproofing thickness is a uniform thickness.

3. The system of claim 1, wherein each of the first mesh surface and the second mesh surface is parallel with respect to each other.

4. The system of claim 1, wherein the formed edge is made of a fireproofing material.

5. The system of claim 1, wherein the formed edge is made of an intumescent epoxy.

6. The system of claim 1, wherein each mesh surface of the set of mesh surfaces is made of a wire mesh.

7. The system of claim 6, wherein the wire mesh comprises:

a plurality of longitudinal ribs;

a plurality of transverse ribs arranged substantially perpendicular to the plurality of longitudinal ribs; and, a plurality of voids defined by the plurality of longitudinal ribs and the plurality of transverse ribs.

* * * * *